United States Patent [19]

Svoboda et al.

[11] 4,035,684

[45] July 12, 1977

[54] STABILIZED PLASMATRON

[75] Inventors: Vratislav Svoboda; Imrich Kleinmann, both of Prague, Czechoslovakia

[73] Assignee: Ustav pro vyzkum, vyrobu a vyuziti radiosotopu, Prague, Czechoslovakia

[21] Appl. No.: 660,773

[22] Filed: Feb. 23, 1976

[51] Int. Cl.[2] ..... H05H 1/00

[52] U.S. Cl. ..... 313/231.4

[58] Field of Search ..... 313/231.3, 231.4, 231.5

[56] References Cited

U.S. PATENT DOCUMENTS

| | | | |
|---|---|---|---|
| 3,304,402 | 2/1967 | Thorpe | 313/231.4 |
| 3,684,911 | 8/1972 | Perugini et al. | 313/231.4 |

FOREIGN PATENT DOCUMENTS

| | | | |
|---|---|---|---|
| 1,186,168 | 4/1970 | United Kingdom | 313/231.4 |

*Primary Examiner*—Palmer C. Demeo

[57] ABSTRACT

Facilities for introducing an additive of arbitrary material state to a plasma stream in a plasmatron is described. An arc discharge established between the cathode and the anode of the plasmatron cooperates with a stream of ionizable gas introduced into the region between such electrodes to produce a plasma stream in a direction toward the anode. An outlet nozzle axially disposed in the anode for ejecting the plasma stream under pressure communicates with an oblique passage extending through the anode for the introduction of the additive into the plasma stream. A plasma stabilization arrangement in the form of apertured plates are disposed in the space between the anode and the cathode, the apertures in the plates being coaxial with and having a diameter larger than the diameter of the nozzle.

2 Claims, 1 Drawing Figure

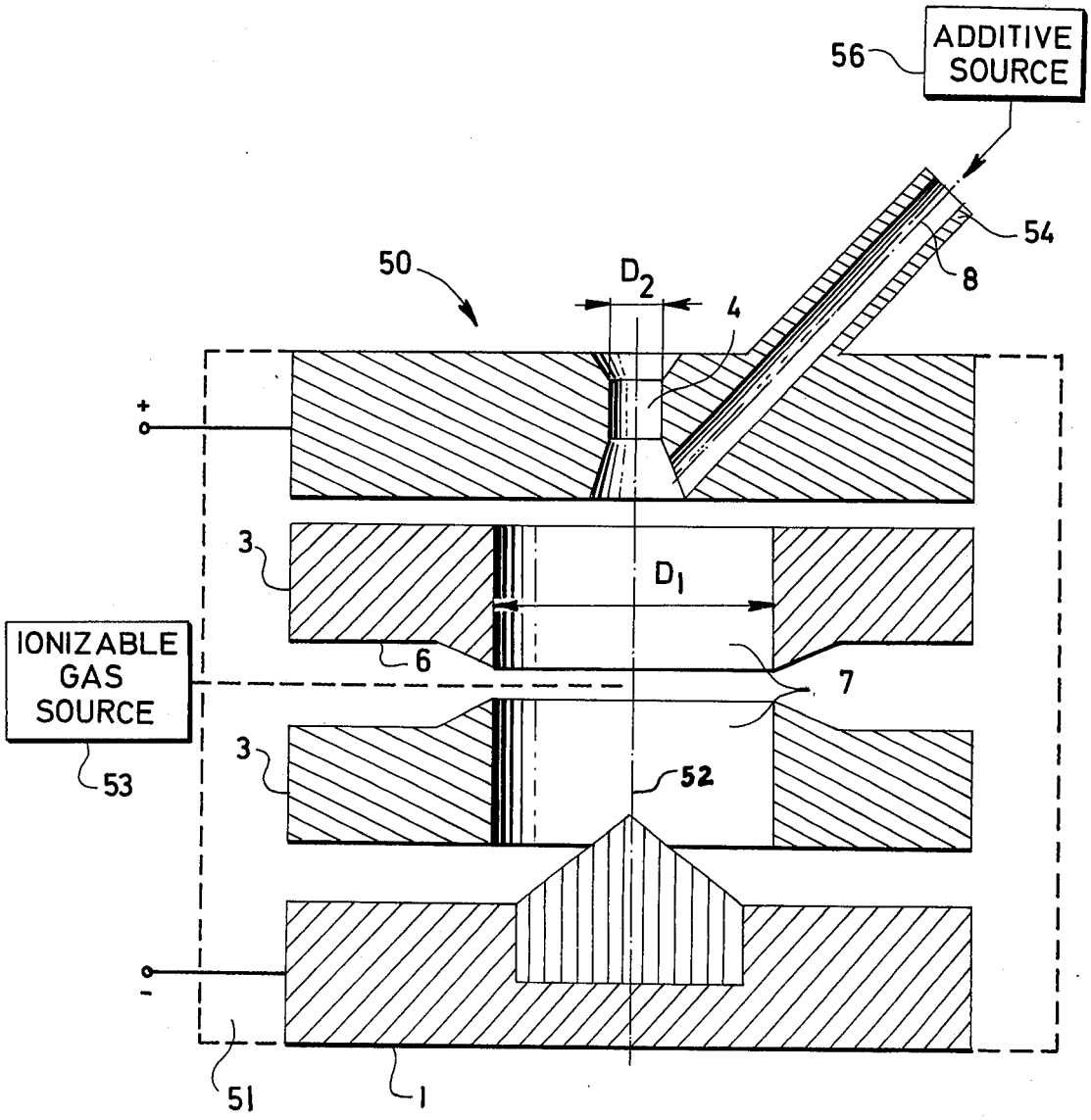
ADDITIVE SOURCE
56
54
8
50
$D_2$
4
+
3
$D_1$
IONIZABLE GAS SOURCE
6
7
53
3
52
-
51
1

STABILIZED PLASMATRON

BACKGROUND OF THE INVENTION

The invention relates to plasmatrons for spectroanalysis applications and the like, and more particularly to stabilized plasmatrons having facilities for introducing additives into the plasma stream developed thereby.

In known types of plasmatrons of this type, an arc is established between spaced cathode and anode electrodes, and an ionizable gas such as argon is introduced into the arc discharge space to define a plasma stream. In one advantageous embodiment, metal plates insulated from the cathode and anode are situated between the cathode and the anode for stabilizing the plasma stream to facilitate a mixing of the plasma with an additive before the stream leaves the device.

The disadvantage of such arrangement, in which the plasma stream is directed from the anode to the cathode, is that extremely high temperatures are generated at the cathode where the beam emerges from the device, thereby leading to frequent failures and breakdowns of the equipment. Additionally, such high temperatures exert a severely limiting effect on the quantity of additives which may be mixed in the plasma stream, and in general limit the material state of the additives to fluid form.

SUMMARY OF THE INVENTION

The stabilized plasmatron of the instant invention avoids these disadvantages. In an illustrative embodiment, a plasma stream is generated in the direction from the cathode to the anode through a plurality of stabilizing plates having a central aperture coaxial with an outlet nozzle in the anode. Additives are introduced into the plasma stream by means of an oblique passage extending through the anode and terminating at the nozzle. Preferably, the diameter of the central apertures in the stabilizing plates, which cooperate with the form factor of the nozzle to yield a desired characteristic of anode-cathode voltage versus arc discharge current, is made larger than the nozzle diameter.

Such advantageous construction has also been found to operate with a low consumption of ionizable gas and highly efficient mixing, with the plasma stream, of additives of arbitrary material state, i.e., gases, liquids, and particulated solids.

BRIEF DESCRIPTION OF THE DRAWING

The invention is further set forth in the following detailed description taken in conjunction with the appended drawing, in which the single FIGURE is an elevation view, partly in section, of a stabilized plasmatron constructed in accordance with the invention.

DETAILED DESCRIPTION

Referring now to the drawing, a plasmatron 50 constructed in accordance with the invention has an outer hermetically-sealed jacket 51 which encases the operative portions of the structure. These include an anode 2, illustratively in the form of a cylindrical plate formed from thoriated tungsten, and a cathode 1 spaced from the anode 2 in a longitudinal direction defined by an axis 52.

A pair of stabilizing plates 3,3, formed from metal insulated from the cathode and anode, is disposed in the space between the cathode and the anode. The plates 3 have aligned central apertures 7,7, and cooperate to define a radial region 6 for the introduction of an ionizable gas into the central region between the anode and the cathode from a suitable source 53.

A suitable DC potential is applied between the anode and the cathode as shown to establish an arc discharge between such electrodes, so that the gas introduced into the region therebetween via the stabilizing plates 3 forms a plasma stream or spray directed from the cathode to the anode along the axis 52. Typically, the ionized gas, illustratively argon, is introduced at a rate of 0.5–10 liters/min., while the DC voltage between the anode and cathode is adjusted to yield an arc discharge current in the range of 5–300 amperes.

The anode is provided with an outlet nozzle 4 extending axially therethrough for ejecting the plasma stream under pressure after a suitable material is added thereto to be analyzed in a conventional manner.

In particular, a tubular structure 54 containing a central passage 8 extends obliquely through the anode 2 to terminate in the region of the nozzle 4. The material of the additive, which is introduced into the passage 8 from a suitable source 56, may be of a wide variety of material states, such as gases, liquids, or particulated solids, e.g., aerosols or powders.

Optimum efficiency of mixing of such wide variety of additives with the plasma stream is accomplished in accordance with the invention by making the inner diameter $D_1$ of the central apertures 7 in the stabilizing plates 3 larger than the diameter $D_2$ of the nozzle 4.

The combination of features discussed above yields a plasmatron structure which exhibits a high reliability and long life, an efficient plasma-additive mixing operation, a low consumption of ionizable gas, and a large flexibility in the types of additives employed.

In the foregoing, an illustrative arrangement of the invention has been described. Many variations and modifications will now occur to those skilled in the art. It is accordingly desired that the scope of the appended claims not be limited to the specific disclosure herein contained.

What is claimed is:

1. In a plasmatron for mixing a liquid, gaseous, aerosol or powdered sample with a plasma stream, the plasmatron comprising, in combination, a cathode, an anode axially spaced from the cathode in a forward direction and having an outlet nozzle extending axially therethrough for ejecting a plasma stream, means for applying a potential across the anode and the cathode to establish an arc discharge therebetween, at least one hollow plasma stabilization plate interposed in the space between the anode and the cathode, means for introducing a gas to be ionized into the space between the anode and cathode occupied by the stabilization plate to produce a plasma stream, and means defining at least one common passage for introducing any of the liquid, gaseous, aerosol or powdered samples into the plasma stream, the common passage extending obliquely in an inward and rearward direction through the anode and terminating in the nozzle for mixing the additive with the plasma stream within the nozzle.

2. A plasmatron as defined in claim 1, in which the stabilization plate has a central aperture of fixed diameter extending throughout its length, the fixed diameter of the stabilization plate aperture being greater than the diameter of the outlet nozzle of the anode.

* * * * *